US008832867B2

(12) United States Patent
Boyle

(10) Patent No.: US 8,832,867 B2
(45) Date of Patent: Sep. 16, 2014

(54) CONVERTIBLE GARMENT WITH CONCEALED ZIPPER SYSTEM

(75) Inventor: Kevin Boyle, Park City, UT (US)

(73) Assignee: Alf Wear, Salt Lake City, UT (US)

( * ) Notice: Subject to any disclaimer, the term of this patent is extended or adjusted under 35 U.S.C. 154(b) by 158 days.

(21) Appl. No.: 13/300,995

(22) Filed: Nov. 21, 2011

(65) Prior Publication Data

US 2013/0125287 A1 May 23, 2013

(51) Int. Cl.
*A41D 1/06* (2006.01)
*A41D 27/10* (2006.01)
*A41D 15/00* (2006.01)

(52) U.S. Cl.
CPC ..... *A41D 15/002* (2013.01)
USPC ..... 2/227; 2/269

(58) Field of Classification Search
USPC ..... 2/227, 228, 238, 269, 126, 124, 79, 70, 2/72, 96, 69, 108; 24/432, 389, 384
See application file for complete search history.

(56) References Cited

U.S. PATENT DOCUMENTS

| | | | | |
|---|---|---|---|---|
| 269,479 | A | 12/1882 | Stretch et al. | |
| 2,104,826 | A * | 1/1938 | Stramiello | 2/126 |
| 2,308,411 | A * | 1/1943 | Wolfson | 2/269 |
| 2,314,226 | A * | 3/1943 | Lee | 2/94 |
| 2,343,103 | A * | 2/1944 | White | 2/115 |
| 4,068,316 | A * | 1/1978 | Haywood | 2/126 |
| 4,190,908 | A * | 3/1980 | Herskind | 2/213 |
| D261,324 | S | 10/1981 | Catron | |
| 4,628,545 | A * | 12/1986 | Metzler | 2/265 |
| 4,766,613 | A * | 8/1988 | Wells | 2/227 |
| D341,919 | S | 12/1993 | Grimes | |
| 5,628,064 | A * | 5/1997 | Chung | 2/70 |
| 5,634,215 | A | 6/1997 | DeBaene | |
| 5,774,892 | A | 7/1998 | Tisdale et al. | |
| 5,864,888 | A * | 2/1999 | Archer | 2/227 |
| 5,924,172 | A * | 7/1999 | Klein | 24/389 |
| D452,988 | S | 1/2002 | Ergezinger et al. | |
| 6,349,413 | B1 * | 2/2002 | Rose et al. | 2/126 |
| D475,836 | S | 6/2003 | Rohach | |
| 6,654,968 | B2 * | 12/2003 | Braun et al. | 2/269 |
| D485,049 | S | 1/2004 | Newson | |
| 6,978,484 | B2 * | 12/2005 | Donlan et al. | 2/227 |
| D536,157 | S | 2/2007 | Kimmel | |
| D542,508 | S | 5/2007 | Zimmerman | |
| D616,630 | S | 6/2010 | Christiansen | |
| D625,490 | S | 10/2010 | Halpern | |
| D641,959 | S | 7/2011 | Abrams et al. | |
| 2005/0246818 | A1 | 11/2005 | Kim | |
| 2008/0092273 | A1 | 4/2008 | Marshall | |
| 2008/0115252 | A1 | 5/2008 | Dahan | |
| 2010/0199399 | A1 * | 8/2010 | Garza | 2/24 |

FOREIGN PATENT DOCUMENTS

| | | |
|---|---|---|
| DE | 31 39 463 A1 | 4/1983 |
| JP | 2001248005 A | 9/2001 |

* cited by examiner

*Primary Examiner* — Amy Vanatta
(74) *Attorney, Agent, or Firm* — Venable LLP; Steven J. Schwarz

(57) ABSTRACT

Convertible pants can include a waist portion, at least one leg connected to the waist portion, each leg including an upper leg portion and lower leg portion removably connected to the upper leg portion by a zipper, the zipper including an upper zipper track attached to the upper leg portion and a lower zipper track attached to the lower leg portion, and an upper zipper flap located on the upper leg portion proximate the upper zipper track, the upper zipper flap including a first reinforced portion extending substantially around the upper leg portion. The upper zipper flap can cover the zipper when the lower leg portion is connected to the upper leg portion by the zipper. A zipper system and garments incorporating the zipper system are also described.

17 Claims, 12 Drawing Sheets

CONVERTIBLE GARMENT WITH CONCEALED ZIPPER SYSTEM

TECHNICAL FIELD

The present application relates generally to convertible garments, such as pants and jackets. More specifically, the present application relates to convertible garments having a concealed zipper system.

BACKGROUND

Convertible garments, such as pants with zip-off legs and jackets with zip-off sleeves, are known in the art. Convertible garments are often used by travelers who may desire to have clothes suitable for a variety of activities and/or conditions, while keeping their amount of luggage to a minimum. Along similar lines, outdoor enthusiasts often use convertible pants and jackets to adjust to varying weather conditions and/or activity levels.

Existing convertible garments often have an unattractive appearance as compared to non-convertible garments, therefore deterring their widespread acceptance. For example, known convertible pants typically include a zipper extending across each leg, and a flap on each leg that hangs from the upper portion of the pants and extends down and over the zipper. This type of arrangement may detract from the overall appearance of the pants. In addition, the relatively long, flexible flap can snag in the zipper when removing or reattaching the legs to the pants, causing the zipper to jam, and/or cutting the fabric of the pants themselves.

There remains a need in the art for garments that remedy the aforementioned and/or other drawbacks of the prior art.

SUMMARY

According to an embodiment, convertible pants can comprise a waist portion; at least one leg connected to the waist portion, the leg comprising an upper leg portion and lower leg portion removably connected to the upper leg portion by a zipper, the zipper comprising an upper zipper track attached to the upper leg portion and a lower zipper track attached to the lower leg portion; and an upper zipper flap located on the upper leg portion proximate the upper zipper track. The upper zipper flap can comprise a first reinforced portion extending substantially around the upper leg portion, wherein the upper zipper flap covers the zipper when the lower leg portion is connected to the upper leg portion by the zipper.

According to another embodiment, a zipper system for a convertible garment can comprise a first garment portion and second garment portion removably connected to the first garment portion by a zipper, the zipper comprising a first zipper track attached to the first garment portion and a second zipper track attached to the second garment portion; and a zipper flap located on the first garment portion proximate the first zipper track. The zipper flap can comprise a first reinforced portion extending substantially around the first garment portion, wherein the zipper flap covers the zipper when the first garment portion is connected to the second garment portion by the zipper. According to another embodiment, a garment, such as a pair of pants, a jacket, or a shirt, incorporates the zipper system.

Further aspects, objectives, and advantages, as well as the structure and function of exemplary embodiments, will become apparent from a consideration of the description, drawings, and examples.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

As used herein, terms such as "front," "back," "left," "right," "upper," and "lower" are used to describe positions relative to one another only and not to denote an absolute position. For example, an "upper portion" can become a "left," "right," or "lower" portion by rotating the item, although it can still be referred to as an "upper" portion of the item.

Referring to FIGS. 1-5, a convertible garment according to the present invention is shown, for example, in the form of convertible pants 10 having removable lower legs. For ease of discussion, the present invention is described in connection with pants 10, however, the invention is not limited to pants. Rather, the invention encompasses other types of convertible garments, such as shirts and jackets with removable sleeves.

Figure 1:
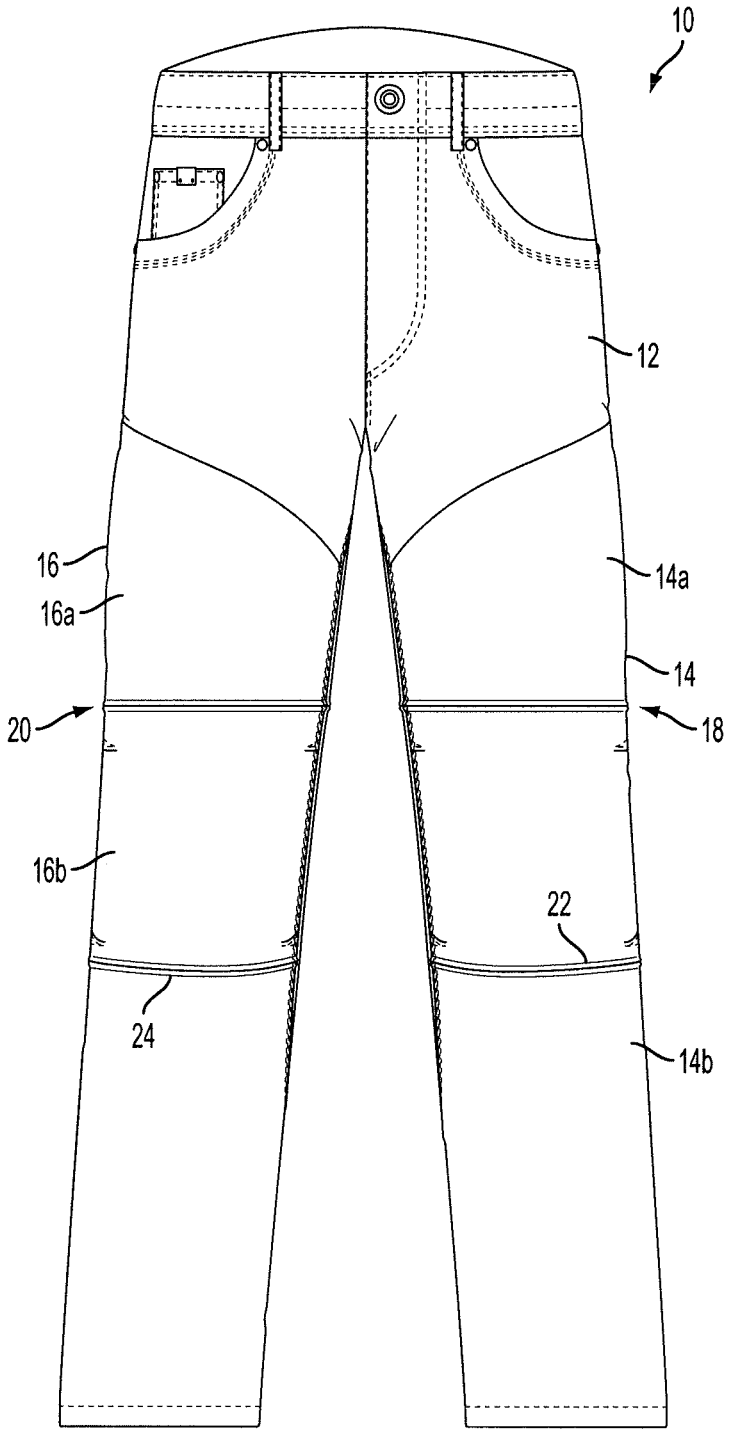
FIG. 1 is a front view of convertible pants according to an embodiment of the present invention.
Figure 2:
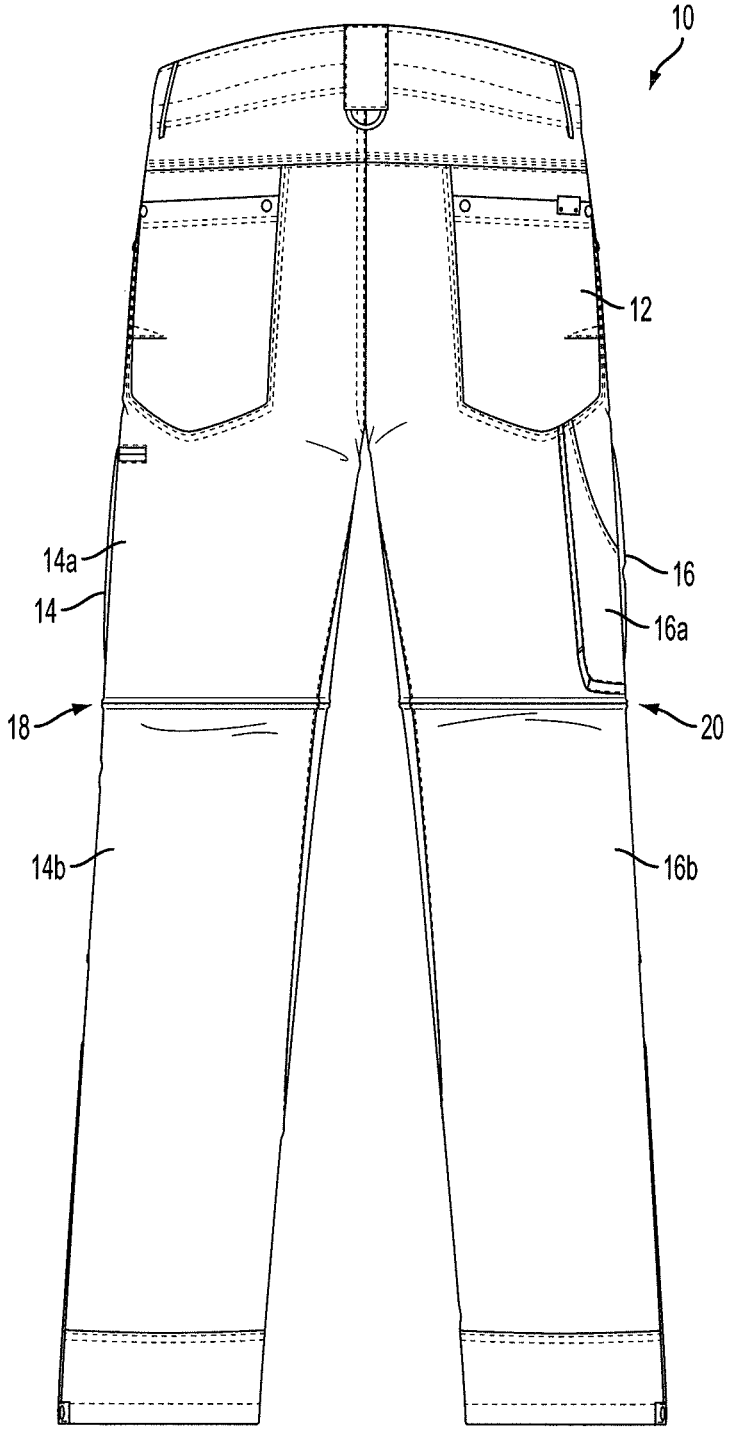
FIG. 2 is a rear view of the convertible pants of FIG. 1.
Figure 3:
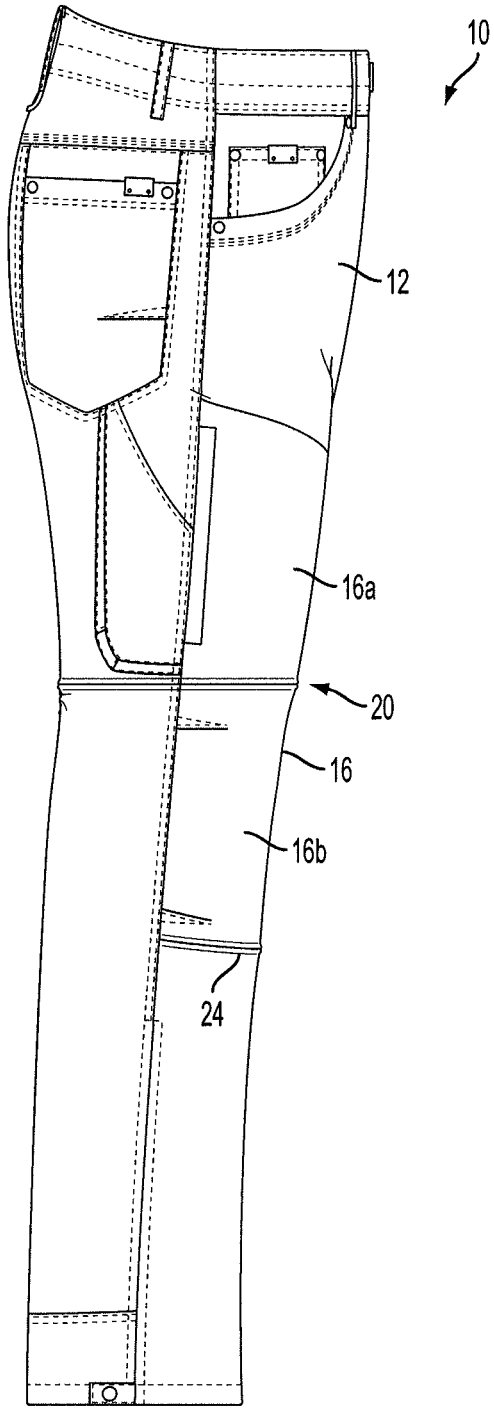
FIG. 3 is a right side view of the convertible pants of FIG. 1.
Figure 4:
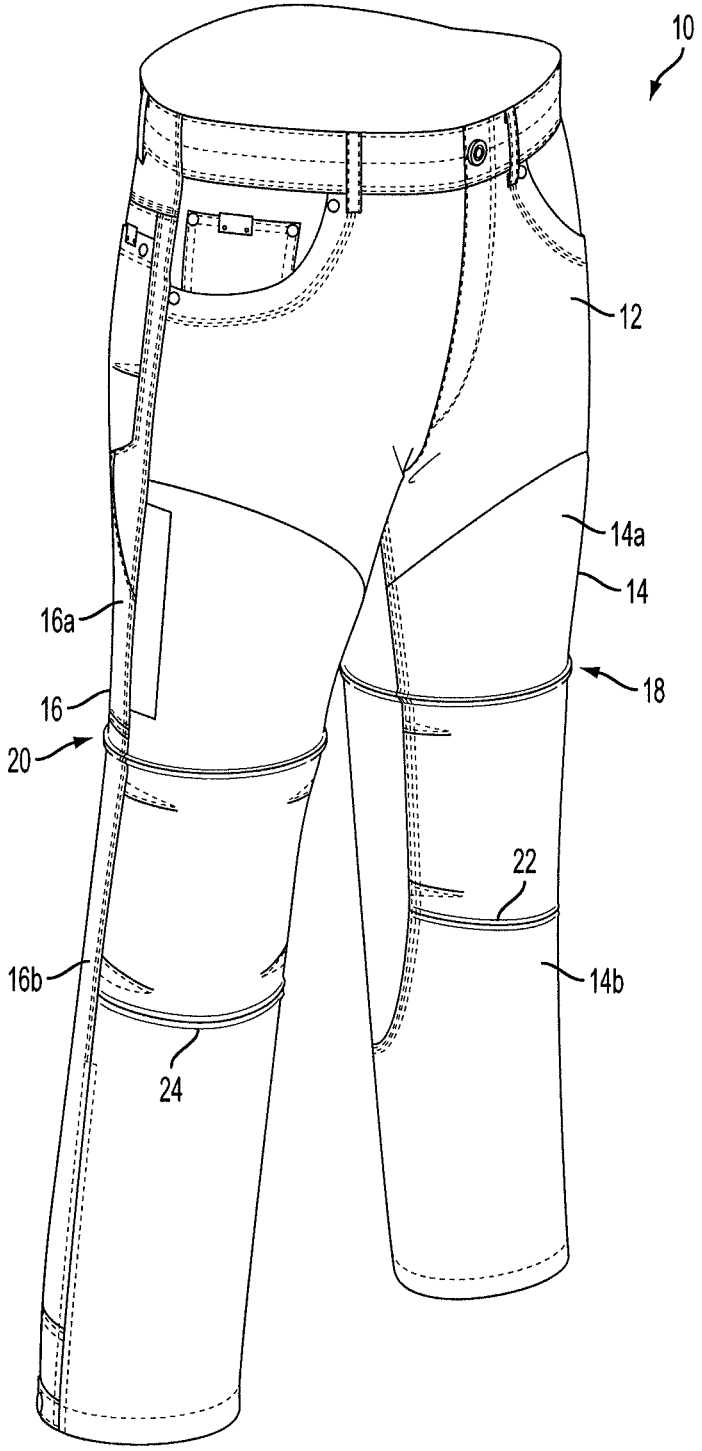
FIG. 4 is a front-right perspective view of the convertible pants of FIG. 1.
Figure 5:
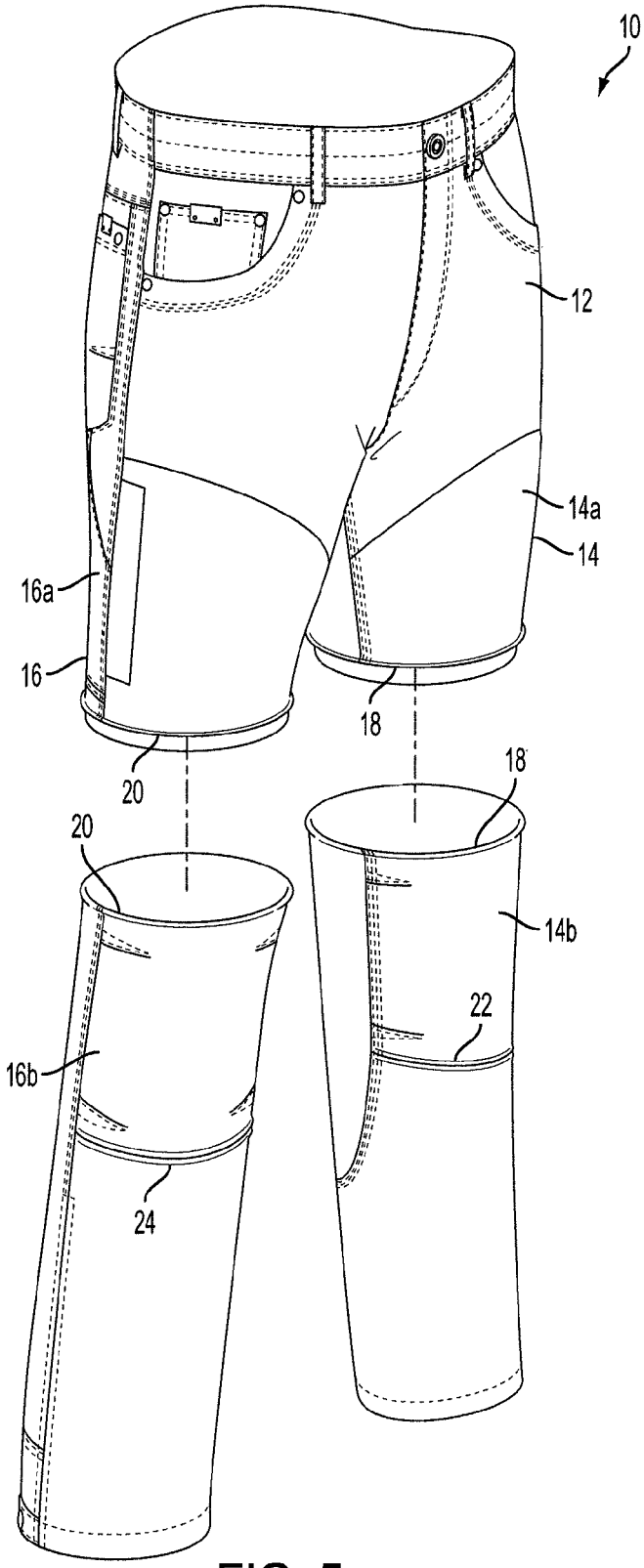
FIG. 5 is a front-right perspective view of the convertible pants of FIG. 1, shown with the lower leg portions removed.

Still referring to FIGS. 1-5, convertible pants 10 can generally include an upper or waist portion 12 and left and right legs 14, 16 extending downward from the waist portion 12. The left leg 14 can include a zipper system 18 that allows a lower portion 14*b* of the left leg 14 to be removed from an upper portion 14*a* of the left leg 14, as shown in FIG. 5. Similarly, the right leg 16 can include a zipper system 20 that allows a lower portion 16*b* of the right leg 16 to be removed from an upper portion 16*a* of the right leg 16, as shown in FIG. 5. Removing the lower portions 14*b*, 16*b* of the left and right legs 14, 16, respectively, allows the wearer to convert the pants 10 into shorts or knickers. The left and right legs 14, 16 can each include a flexible hinge joint 22, 24, for example, in the respective lower leg portions 14*b*, 16*b*. Additional details regarding the flexible hinge joints 22, 24 will be discussed below. The pants 10 can include additional features known in the art, such as pockets, pleats, belt loops, a zip or button fly, etc., which will not be described further herein.

Pants 10 can be constructed using various fabrics and construction techniques known in the art. For example, pants 10 can be constructed from man made and/or natural fiber fabrics, such as cotton, cotton/nylon blends, cotton/spandex blends, nylon/spandex blends, polyester, and polyester blends. According to an embodiment, pants 10 can be constructed from a 77% nylon/23% cotton blend. Other materials and/or combinations of materials will be identifiable by one of ordinary skill in the art based on this disclosure depending on the intended style and/or use of the pants. According to an embodiment, all or a portion of the fabric for pants 10 can be coated, for example, with a durable water repellant (DWR) or other coating. Pants 10 can be constructed by joining multiple panels of fabric using techniques such as, for example, sewing, gluing, or ultrasonic bonding.

Figure 6:
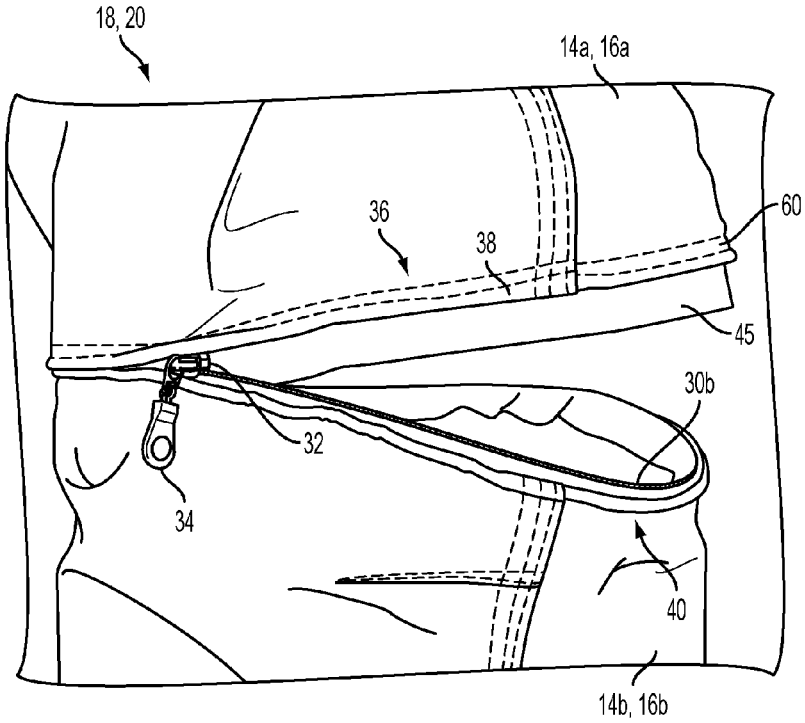
FIG. 6 is a perspective view of a zipper system of the pants of FIG. 1, showing the lower leg portion partially unzipped from the upper leg portion.
Figure 7:
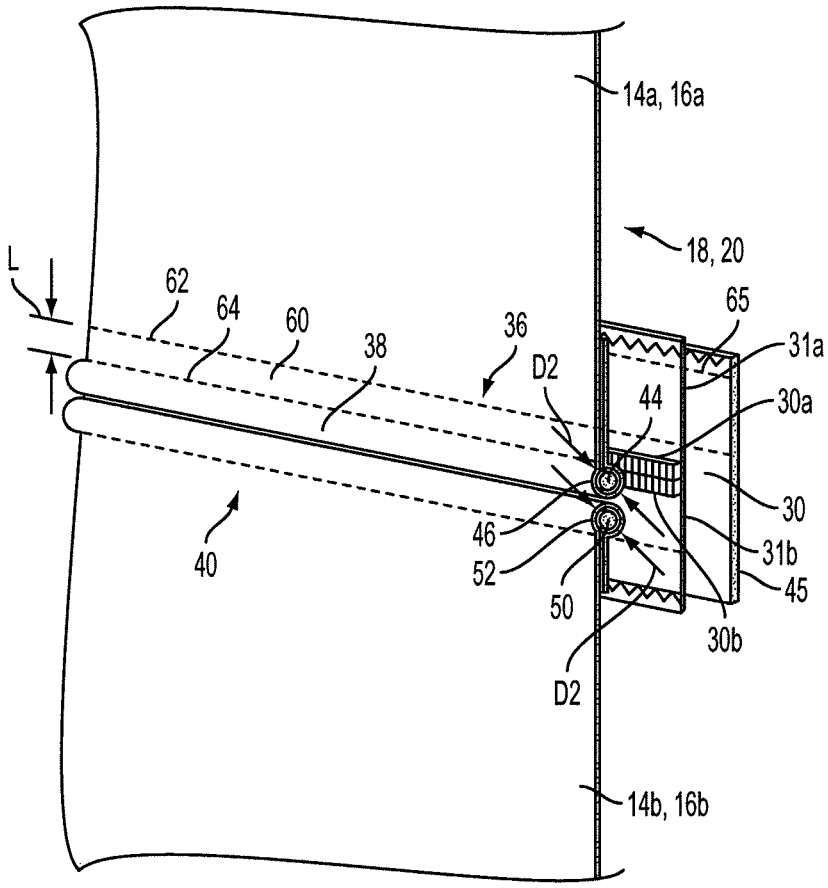
FIG. 7 is a side, partial cross-sectional view of the zipper system of FIG. 6.

Referring to FIG. 6, a detailed perspective view of zipper system 18 (from left leg 14) or zipper system 20 (from right leg 16) is shown. FIG. 7 is a partial cross-sectional view of zipper system 18 or 20. One of ordinary skill in the art will appreciate from this disclosure that zipper system 18 and zipper system 20 can be substantially the same, or can be mirror images of one another, although embodiments are possible where zipper systems 18, 20 are different from one another. For ease of explanation, further discussion of the zipper systems 18, 20 refers to the zipper system 18, however, the discussion applies equally to zipper system 20, unless noted otherwise.

Referring to FIGS. 6 and 7 in conjunction, the zipper system 18 can include a zipper 30 including an upper zipper track 30*a* and a lower zipper track 30*b*. As shown, the upper zipper track 30*a* can be attached to the upper leg portion 14*a*, for example, by sewing the upper zipper tape 31*a* to the upper leg portion 14*a*, and the lower zipper track 30*b* can be attached to the lower leg portion 14*b*, for example, by sewing the lower zipper tape 3*b* to the lower leg portion 14*b*. The zipper 30 can also include a slider 32, shown in FIG. 6, that slides along the zipper tracks 30*a*, 30*b* to open and close the zipper 30. The slider 32 can include a zipper pull 34 that allows a wearer of the pants to easily grasp and move the slider 32. According to an embodiment, the zipper 30 can have concealed elements on the upper and lower zipper tracks 30*a*, 30*b*, for example, the zipper 30 may comprise a #3 coil zipper from YKK U.S.A. Inc., of Marietta, Ga., however other configurations are possible. According to an embodiment, the zipper 30 can be a reverse coil zipper, so that only the zipper tape 31*a*, 31*b* shows on the outside of the pants, and the zipper tracks 30*a*, 30*b* are substantially concealed. According to another embodiment, the zipper 30 can be a micro coil zipper having a width of approximately 2 mm.

Still referring to FIGS. 6 and 7, the pants 10 can include an upper zipper flap 36 that extends downward from the upper leg portion 14*a*, and overlays all or a portion of the visible side surface of upper and lower zipper tracks 30*a*, 30*b*, when closed. As shown, the upper zipper flap 36 can include a first reinforced portion 38, such as a cord casing housing a cord, that extends substantially transversely around the upper leg portion 14*a*. According to an embodiment, first reinforced portion 38 can define a first cross-section in a direction substantially transverse to the zipper tracks 30*a*, 30*b* (see FIG. 7) that is substantially circular, however, other cross-sectional geometries such as square, rectangular, triangular, and polygonal are also possible.

As also shown in FIGS. 6 and 7, the pants 10 can include a second reinforced portion 40 on the lower leg portion 14*b*, such as a second cord casing housing a second cord. The second reinforced portion 40 can extend substantially transversely around the lower leg portion 14*b*, proximate the lower zipper track 30*b*. The second reinforced portion 42 can define a second cross-section in a direction substantially transverse to the zipper tracks 30*a*, 30*b* (see FIG. 7) that is substantially circular, however, other cross-sectional geometries such as square, rectangular, triangular, and polygonal are also possible. According to an embodiment, the first reinforced portion 38 and the second reinforced portion 40 can contact or substantially contact one another when the zipper 30 is closed, for example, to sufficiently conceal the zipper 30 from view when the pants 10 are viewed from a distance of two or more feet. According to an embodiment, first reinforced portion 38 and the second reinforced portion 40 can be separated by a distance of no more than about 1 mm to about 2 mm, however other configurations are possible.

Referring to FIG. 7, the first reinforced portion 38 can comprise a first reinforcement insert 44 wrapped in at least one layer of fabric 46. According to the embodiment shown, the fabric 46 from the upper leg portion 14*a* can loop snugly around the first reinforcement insert 44 and fold back against itself, where it may be secured in place by the stitching 62 for the upper zipper track 30*a* and/or zipper fly 45, however, other configurations are possible. The second reinforced portion 40 can likewise comprise a second reinforcement insert 50 wrapped in at least one layer of fabric 52, for example, the fabric from the lower leg portion 14*b*, and can be constructed in the same or similar manner as described above, however, other configurations are possible.

According to an embodiment, the first reinforcement insert 44 and/or second reinforcement insert 50 can be made of a natural and/or manmade material, such as fiber, that is incompressible or substantially incompressible. For example, the inserts 44, 40 may be sufficiently incompressible to resist the first or second reinforced portion 38, 40, respectively, from snagging between the zipper tracks 30*a*, 30*b* or catching between the slider 32 and one or more of the zipper tracks 30*a*, 30*b* during operation of the zipper 30. For example, according to an embodiment, at least one of the first reinforcement insert 44 and the second reinforcement insert 50 can comprise, without limitation, braided nylon cord, solid nylon cord, rubber, or plastic.

According to the embodiment shown in FIG. 7, the first reinforced portion 38 can define a first diameter D1 of between about 2 mm and about 4 mm. According to an embodiment, the diameter D1 can be between about 2 mm and about 3 mm, however other dimensions are possible. The second reinforced portion 40 can define a diameter D2 of between about 2 mm and about 4 mm. According to an embodiment, the diameter D2 can be between about 2 mm and 3 mm, however other dimensions are possible.

Referring to FIGS. 6 and 7, the upper zipper flap 36 may include a bridge portion 60 that, for example, may extend freely from the upper leg portion 14*a* to the first reinforced portion 38. According to an embodiment, the bridge portion 60 may be substantially flexible and may comprise, for example, one or more layers of fabric 46 extending freely from the row of stitching 62 for the upper zipper track 30*a* to the row of stitching 64 that closes the fabric 46 of the upper zipper flap 36 snugly around the first reinforcement insert 44. For example, the bridge portion can be formed by the fabric 46 of the upper leg portion 14*a* extending down and around the first reinforcement insert 44, looping around the insert 44, and folding back against itself, although other configurations are possible. As shown in FIGS. 6 and 7, the zipper system 18 can also include a zipper fly 45 secured to the upper leg portion 14*a*, for example, by row of stitching 62 and/or to upper zipper track 30*a*, for example, by row of stitching 65.

The upper zipper flap 36 and/or the combination of the upper zipper flap 36 and the second reinforced portion 40 can conceal or substantially conceal the zipper 30 from view when the lower leg portion 14*b* is connected to the upper leg portion 14*a*, thereby helping to disguise that the pants 10 have a removable lower leg portions 14*b*, 16*b*.

Still referring to FIG. 7, the bridge portion 60 can define a length L, for example, between rows of stitching 62 and 64, of between about 2 mm and about 4 mm. According to another embodiment, the length L can be between about 2.5 mm and about 3.5 mm. According to an embodiment, the length L can be about 3 mm, and the first diameter D1 of the first reinforced portion 38 can be about 2.5 mm, however, other configurations are possible. As a result, the upper zipper flap 36 can extend down approximately 5-6 mm over the zipper 30 to meet, match, or touch the second reinforced portion 40. This configuration can provide just enough room for the zipper slider 32 and pull 34 to operate effectively. Furthermore, the first and/or second reinforced portions 38, 40 can provide the added structure needed to prevent the zipper slider 32 from catching in or on the fabric of the upper zipper flap 36, keeping the zipper 30 operating smooth and easy.

As shown in FIG. 7, the second reinforced portion 40, such as a cord casing housing a length of cord, can be sewn directly to the lower leg portion 14*b*, for example, to the lower zipper tape 31*b*. According to this embodiment, since the second reinforced portion 40 is sewn directly at the casing, there is no lower "flap" extending upwards, rather, only the cord casing and housed cord extend out beyond/above the stitching. As a result, in this embodiment, the second reinforced portion 40 may not fall down or fold over onto itself after extended wear.

Figure 8:
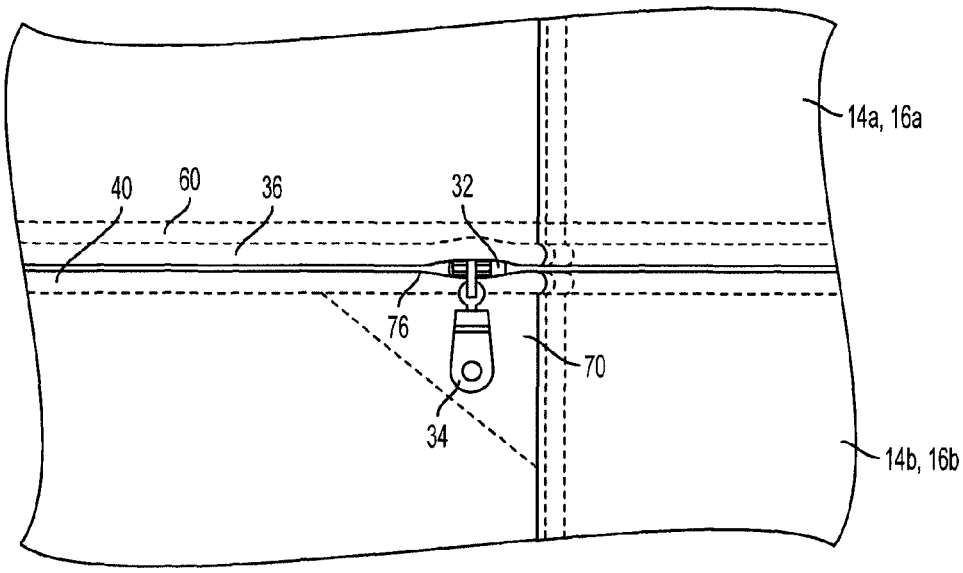
FIG. 8 is a side, close up view of the zipper system of FIG. 6, showing a zipper pull outside of a zipper pull storage pocket.
Figure 9:
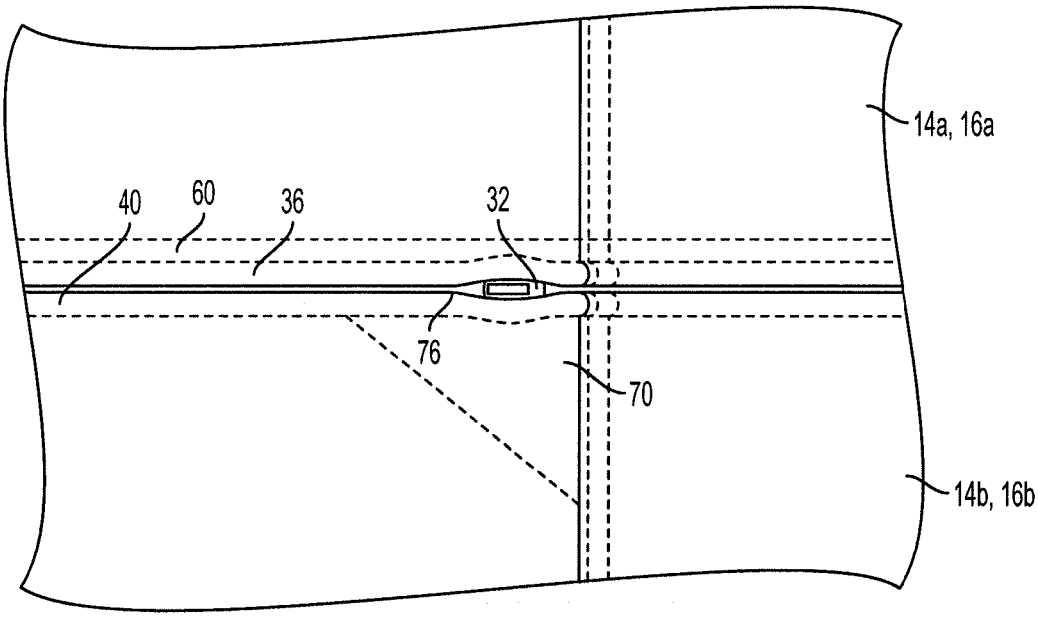
FIG. 9 is a side, close up view of the zipper system of FIG. 6, shown with the zipper pull inside the zipper pull storage pocket.
Figure 10:
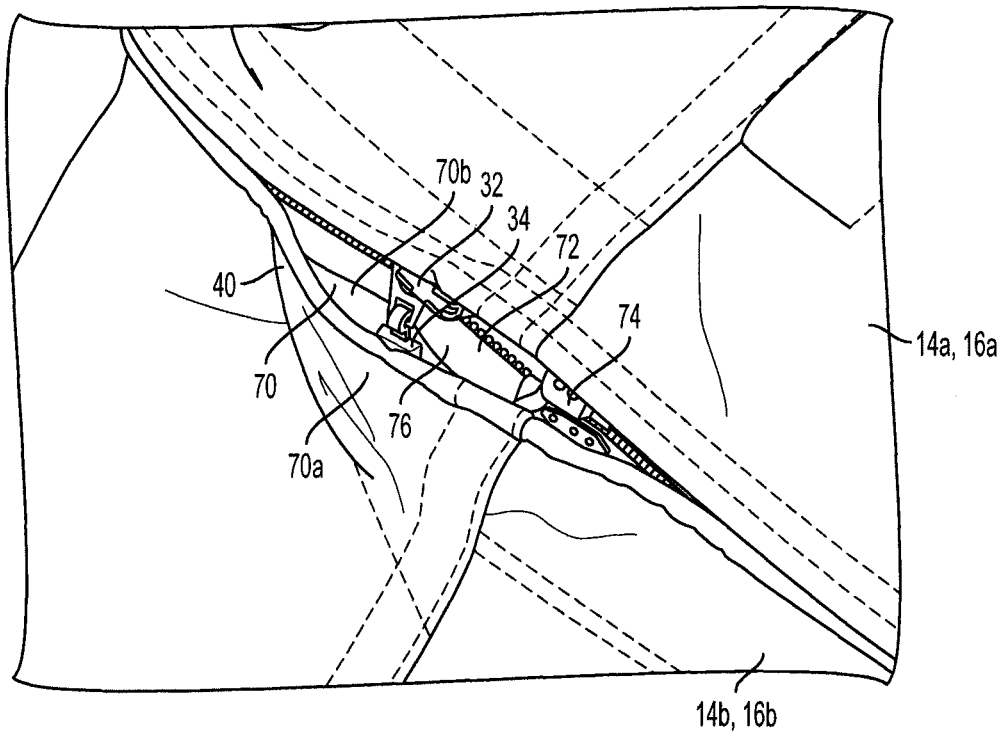
FIG. 10 is a perspective view of the zipper pull storage pocket of FIG. 8, shown with the zipper pull inside the zipper pull storage pocket.

Referring to FIGS. 8-11, a zipper pull storage pocket 70 is shown. The zipper pull storage pocket 70 can comprise an opening between two or more layers of fabric 70*a*, 70*b* (see FIG. 10) that can store the zipper pull 34 when the zipper 30 is in or near the fully closed position (e.g., the lower leg portion 14*b* is fully connected to the upper leg portion 14*a*). As shown in FIG. 10, the upper and lower zipper tracks 30*a*, 30*b* can together define a first zipper end 72 and a second zipper end 74. When the slider 32 is at or near the first zipper end 72, the zipper 30 is closed and the lower leg portion 14*b* is secured to the upper leg portion 14*a*. Moving the slider 32 until it is at or near second zipper end 74 causes the zipper 30 to open, allowing the lower leg portion 14*b* to be removed from the upper leg portion 14*a*. According to an embodiment, the first and second zipper ends 72, 74 can be oriented such that the zipper 30 opens from the side of the wearer's leg toward the back of the wearer's leg, allowing the user the option to partially open the zipper 30 and vent the rear portion of her leg.

As shown in FIGS. 8-10, the zipper pull storage pocket 70 can be located near the first zipper end 72. Thus, when the zipper 30 is at or near the fully closed position, the zipper pull 34 can be placed into the zipper pull storage pocket 70 (See FIGS. 9 and 10) and substantially concealed from view. According to an embodiment, the zipper pull storage pocket 70 can have an opening 76 (e.g., defined between the two layers of fabric 70*a*, 70*b*) through which the zipper pull 34 is inserted to enter the zipper pull storage pocket 70, although other configurations are possible. The opening 76 can extend along the second reinforced portion 40, as shown, however other configurations are possible. While the zipper pull storage pocket 70 is shown in the lower leg portion 14*b*, alternative embodiments may additionally or alternatively include a zipper pull storage pocket in the upper leg portion 14*a*. The zipper pull storage pocket 70 may conceal or substantially conceal the zipper pull 34 from view, thus further concealing that the pants 10 have removable lower leg portions 14*b*, 16*b*.

Figure 11:
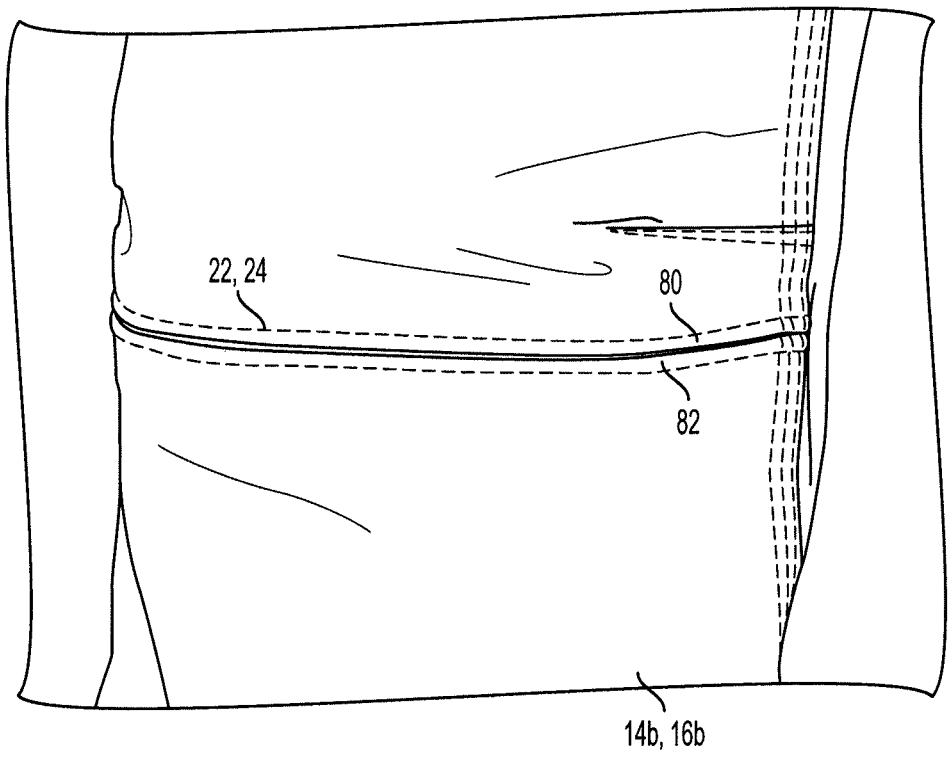
FIG. 11 is a side view of a flexible hinge joint according to an embodiment of the present invention, shown in a relaxed position.
Figure 12:
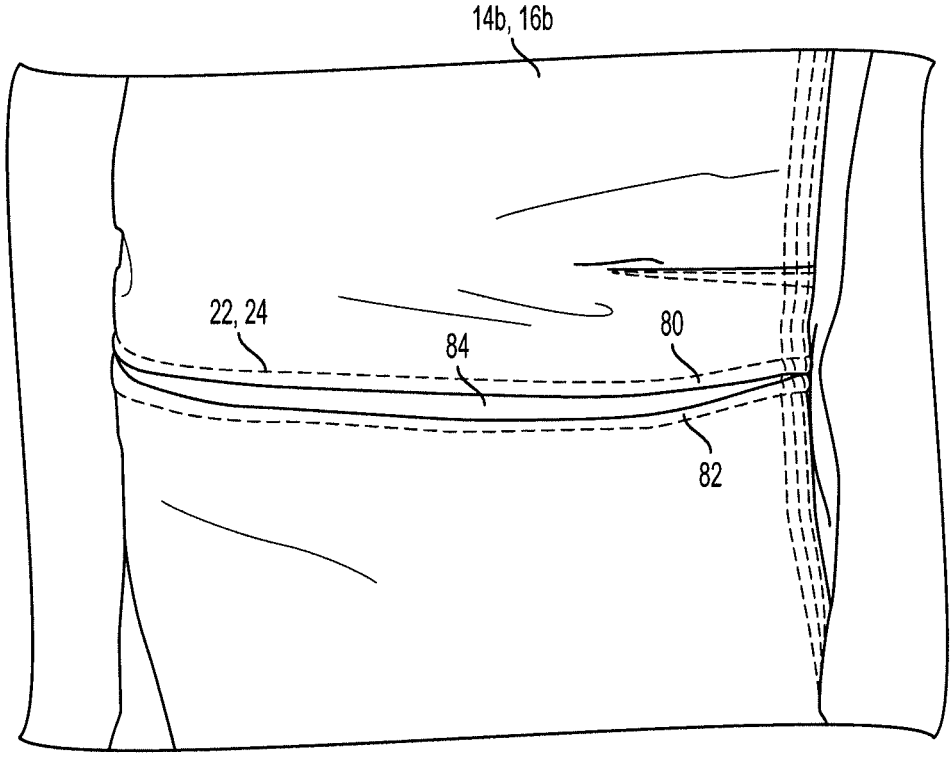
FIG. 12 is a side view of the flexible hinge joint of FIG. 11, shown in a stretched position.

Referring to FIGS. 11 and 12, further details of the flexible hinge joints 22, 24 of FIGS. 1 and 3-5 are shown. One of ordinary skill in the art will appreciate from this disclosure that hinge joints 22, 24 can be substantially the same, or can be mirror images of one another, although embodiments are possible where hinge joints 22, 24 are different from one another. For ease of explanation, further discussion of the hinge joints 22, 24 refers to the hinge joint 22 in the left leg 14, however, the discussion applies equally to the hinge joint 24 in the right leg 16, unless noted otherwise.

Still referring to FIGS. 11 and 12, the hinge joint 22 can comprise third and fourth reinforced portions 80, 82 extending at least partially across the lower leg portion 14*b*. The third and fourth reinforced portions 80, 82 can be formed in the same or similar manner as described above in connection with the first and/or second reinforced portions 38, 40, however, alternative techniques are possible.

The hinge joint 22 can further comprise a span of stretchy or elastic material 84 (see FIG. 12) between the third and fourth reinforced portions 80, 82, thereby forming a flexible hinge or joint that can expand and contract between a relaxed position (see FIG. 11) and a stretched position (see FIG. 12), for example, in order to accommodate movement by the wearer, such as kneeling. The material 84 can comprise, for example, spandex, or woven or knit material of man made and/or natural fibers. According to the embodiment shown, the hinge joint 22 is located in the lower leg portion 14*b* slightly below the wearer's knee region, and the zipper system 18 is located slightly at or above the wearer's knee. As such, the zipper system 18 and the hinge joint 22 can create an aesthetically pleasing accent piece around the wearer's knee. However, the hinge joint is not limited to being substantially parallel to the zipper 30, as shown, and other configurations are possible. In addition, although the hinge joint 22 is shown in the lower leg portion 14*b*, alternative embodiments can additionally or alternatively include a hinge joint 22 in the upper leg portion 14*a* or other portion of the pants 10. According to an embodiment, the hinge joint 22 can have the same or similar appearance as the zipper system 18, thus complementing the appearance of the zipper 18.

The features described above are not limited to use with pants 10, and can alternatively be used with other types of garments, such as shirts and jackets, for example, with removable sleeves. For example, in instances other than pants 10, the zipper system can be used to connect mating "first" and "second" garment portions, such as first and second portions of a sleeve, in which event the respective "upper" and "lower" elements discussed above are referred to as "first" and "second" elements, respectively. Furthermore, in some instances, the "first" and "second" garment portions may refer to garments having removably connected "left" and "right" portions, and are not limited to just "upper" and "lower" arrangements of parts.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. Convertible pants, comprising:

a waist portion;

at least one leg connected to the waist portion, each leg comprising an upper leg portion and lower leg portion removably connected to the upper leg portion by a zipper, the zipper comprising an upper zipper track attached to the upper leg portion and a lower zipper track attached to the lower leg portion;

an upper zipper flap located on the upper leg portion proximate the upper zipper track, the upper zipper flap comprising a first reinforced portion extending substantially around the upper leg portion and a substantially flexible bridge portion extending between the upper leg portion and the first reinforced portion; and a second reinforced portion located on the lower leg portion proximate the lower zipper track, the second reinforced portion extending substantially around the lower leg portion, wherein the first and second reinforced portions each include an incompressible or substantially incompressible reinforcement insert surrounded by at least one layer of fabric, wherein the upper zipper flap covers the zipper when the lower leg portion is connected to the upper leg portion by the zipper, and the first reinforced portion and the second reinforced portion substantially contact one another without overlapping when the lower leg portion is connected to the upper leg portion by the zipper.

2. The convertible pants of claim 1, wherein the reinforcement insert comprises braided nylon cord, solid nylon cord, rubber, or plastic.

3. The convertible pants of claim 1, wherein the first reinforced portion defines a first substantially circular cross-section having a diameter of between about 2 and about 4 millimeters.

4. The convertible pants of claim 3, wherein the second reinforced portion defines a second substantially circular cross-section having a diameter of between about 2 and about 4 millimeters.

5. The convertible pants of claim 4, wherein the bridge portion defines a length from the upper leg portion to the first reinforced portion of between about 2 and about 4 millimeters.

6. The convertible pants of claim 1, wherein the zipper includes a zipper pull movable between a first zipper end and a second zipper end, and the lower leg portion includes a zipper pull storage pocket located proximate the first zipper end.

7. The convertible pants of claim 6, wherein the zipper pull storage pocket includes an open side that extends along the lower zipper rack.

8. Convertible pants, comprising:

a waist portion;

at least one leg connected to the waist portion, each leg comprising an upper leg portion and lower leg portion removably connected to the upper leg portion by a zipper, the zipper comprising an upper zipper track attached to the upper leg portion and a lower zipper track attached to the lower leg portion;

an upper zipper flap located on the upper leg portion proximate the upper zipper track, the upper zipper flap comprising a first reinforced portion extending substantially around the upper leg portion, wherein the upper zipper flap covers the zipper when wer leg ortion is connected to the upper leg portion by the zipper; and a flexible hinge joint located in the lower leg portion below the lower zipper track, the flexible hinge joint comprising:

a second reinforced portion extending at least partially across the lower leg portion;

a third reinforced portion extending at least partially across the lower leg portion at a distance from the third reinforced portion; and a span of substantially elastic material extending between the second reinforced portion and the third reinforced portion.

9. The convertible pants of claim 8, wherein the first and second reinforced portions extend substantially parallel to the zipper.

10. A zipper system for a convertible garment, comprising:

a first garment portion and second garment portion removably connected to the first garment portion by a zipper, the zipper comprising a first zipper track attached to the first garment portion and a second zipper track attached to the second garment portion; and a zipper flap located on the first garment portion proximate the first zipper track, the zipper flap comprising a first reinforced portion extending substantially around the first garment portion and a substantially flexible bridge portion extending between the first garment portion and the first reinforced portion; and a second reinforced portion located on the second garment portion proximate the second zipper track, the second reinforced portion extending substantially around the second garment portion, wherein the first and second reinforced portions each include an incompressible or substantially incompressible reinforcement insert surrounded by at least one layer of fabric, wherein the zipper flap covers the zipper when the first garment portion is connected to the second garment portion by the zipper, and the first reinforced portion and the second reinforced portion substantially contact one another without overlapping when the second garment portion portion is connected to the first garment portion by the zipper.

11. The zipper system of claim 10, wherein the reinforcement insert comprises braided nylon cord, solid nylon cord, rubber, or plastic.

12. The zipper system of claim 10, wherein the bridge portion is substantially flat.

13. The zipper system of claim 10, wherein the zipper includes a zipper pull movable between a first zipper end and a second zipper end, and the second garment portion includes a zipper pull storage pocket located proximate the first zipper end.

14. The zipper system of claim 13, wherein the zipper pull storage pocket includes an open side that extends along the second zipper track.

15. The zipper system of claim 10, further comprising a flexible hinge joint located in the second garment portion, the flexible hinge joint comprising:

a third reinforced portion extending at least partially across the second garment portion;

a fourth reinforced portion extending at least partially across the second garment portion; and a span of substantially elastic material extending between the third reinforced portion and the fourth reinforced portion.

16. The zipper system of claim 15, wherein the third and fourth reinforced portions extend substantially parallel to the zipper.

17. A convertible garment comprising the zipper system of claim 10, wherein the convertible garment is a pair of pants, a jacket, or a shirt.

* * * * *

UNITED STATES PATENT AND TRADEMARK OFFICE

CERTIFICATE OF CORRECTION

PATENT NO. : 8,832,867 B2
APPLICATION NO. : 13/300995
DATED : September 16, 2014
INVENTOR(S) : Kevin Boyle It is certified that error appears in the above-identified patent and that said Letters Patent is hereby corrected as shown below:

In the claims:

In claim 7, column 7, line 62, “rack” should be --track--.

Signed and Sealed this
Thirtieth Day of December, 2014

Michelle K. Lee

Michelle K. Lee
*Deputy Director of the United States Patent and Trademark Office*